US007469882B2

(12) United States Patent
Frommelt

(10) Patent No.: US 7,469,882 B2
(45) Date of Patent: Dec. 30, 2008

(54) HOOK-TYPE BOTTOM BLOCK

(75) Inventor: Uwe Frommelt, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 90 days.

(21) Appl. No.: 11/584,342

(22) Filed: Oct. 20, 2006

(65) Prior Publication Data

US 2007/0090658 A1 Apr. 26, 2007

(30) Foreign Application Priority Data

Oct. 25, 2005 (DE) ..... 20 2005 016 742 U

(51) Int. Cl.
*B66D 3/08* (2006.01)

(52) U.S. Cl. ..... 254/393; 254/401; 294/82.11; 294/86.41

(58) Field of Classification Search ..... 254/393, 254/401; 294/82.1, 82.11, 82.15, 86.41
See application file for complete search history.

(56) References Cited

U.S. PATENT DOCUMENTS 484,038 A * 10/1892 Morgan ..... 254/399
2,973,942 A * 3/1961 Schaper ..... 254/399
3,794,185 A * 2/1974 Kroll et al. ..... 254/399
3,936,034 A * 2/1976 Larralde ..... 254/399
4,721,286 A * 1/1988 Hey et al. ..... 254/399
5,476,247 A * 12/1995 Melder ..... 254/404
6,386,516 B1 * 5/2002 Lenders ..... 254/393
6,991,275 B2 * 1/2006 Zollondz et al. ..... 294/82.15
2004/0183061 A1 * 9/2004 Winter et al. ..... 254/411

FOREIGN PATENT DOCUMENTS

DE 28 53 404 10/1984
DE 101 10 302 7/2002
GB 2 179 908 3/1987

* cited by examiner

*Primary Examiner*—Emmanuel M Marcelo
(74) *Attorney, Agent, or Firm*—Alleman Hall McCoy Russell & Tuttle LLP

(57) ABSTRACT

The present disclosure relates to a hook-type bottom block for a crane, preferably a mobile crane, comprising a lower part to which the hook is fastened in a rotatable and tiltable manner and an upper part in which rollers are supported via which at least one hoist rope can be sheared in. In accordance with the present disclosure, the rollers are combined in a plurality of roller sets connectable to one another in a modular manner.

18 Claims, 3 Drawing Sheets

HOOK-TYPE BOTTOM BLOCK

CROSS REFERENCE TO RELATED APPLICATION

This application claims priority to German Utility Model Application No. 20 2005 016 742.8, filed Oct. 25, 2005, which is hereby incorporated by reference in its entirety for all purposes.

FIELD

The present disclosure relates to a hook-type bottom block for a crane, preferably for a mobile crane.

BACKGROUND AND SUMMARY

A hook-type bottom block is the connection between the hoist rope of a crane and the load. The hook-type bottom block has a lower part to which a correspondingly shaped hook is fastened in a rotatable and tiltable manner. Sheaves, which are called rollers in the following, are arranged on a shaft in the upper part connected to this lower part. The hoist rope is sheared in via the rollers in accordance with the block and pulley principle.

Depending on the task, hook-type bottom blocks with different roller sets have to be used. For this purpose, a number of different hook-type bottom blocks must be produced and kept in store.

It is the object of the present disclosure to minimize the production effort and the storage for hook-type bottom blocks.

This object is satisfied in accordance with the present disclosure in that, with a generic hook-type bottom block for a crane having a lower part to which the hook is fastened in a rotatable and tiltable manner and having an upper part in which the rollers are supported via which at least one hoist rope can be sheared in, the rollers are combined into a plurality of roller sets which can be connected to one another in the manner of modules. In accordance with the present disclosure, different bottom blocks can therefore be made up from the individual modules using the modular system principle. This increases the flexibility in use of the hook-type bottom block taken along since the individual modules of the hook-type bottom block can be combined differently with one another for different uses.

In one example, the rollers can be connected to the hook via a hook yoke.

Further, a pair having two respective roller sets of different roller numbers can be connected to one another here. The roller sets can each be bolted to one another. The different roller set constellations can thereby be put together very simply.

When the hook-type bottom block is made with a pair having two respective roller sets of different roller numbers, two hoist ropes can advantageously be sheared in by two winches, with the winches being able to be run in parallel operation and with the different running behavior of both winches, which cannot be avoided, being able to be compensated via the hook yoke. For this purpose, the individual roller sets combined with one another in each case are connected to one another in an oscillating manner via the hook yoke.

In a preferred embodiment of the present disclosure, only some of the roller sets can be connected to one another in a different combination. A plurality of hook-type bottom block constellations can thus be put together depending on use. The respective roller sets can be combined with one another for this purpose. Depending on the width and design of the roller sets, however, different hooks and hook yokes must be used.

BRIEF DESCRIPTION OF FIGURES

Further features, details and advantages of the present disclosure will be explained in more detail with reference to embodiments shown in the drawings.

DETAILED DESCRIPTION

Figure 1:
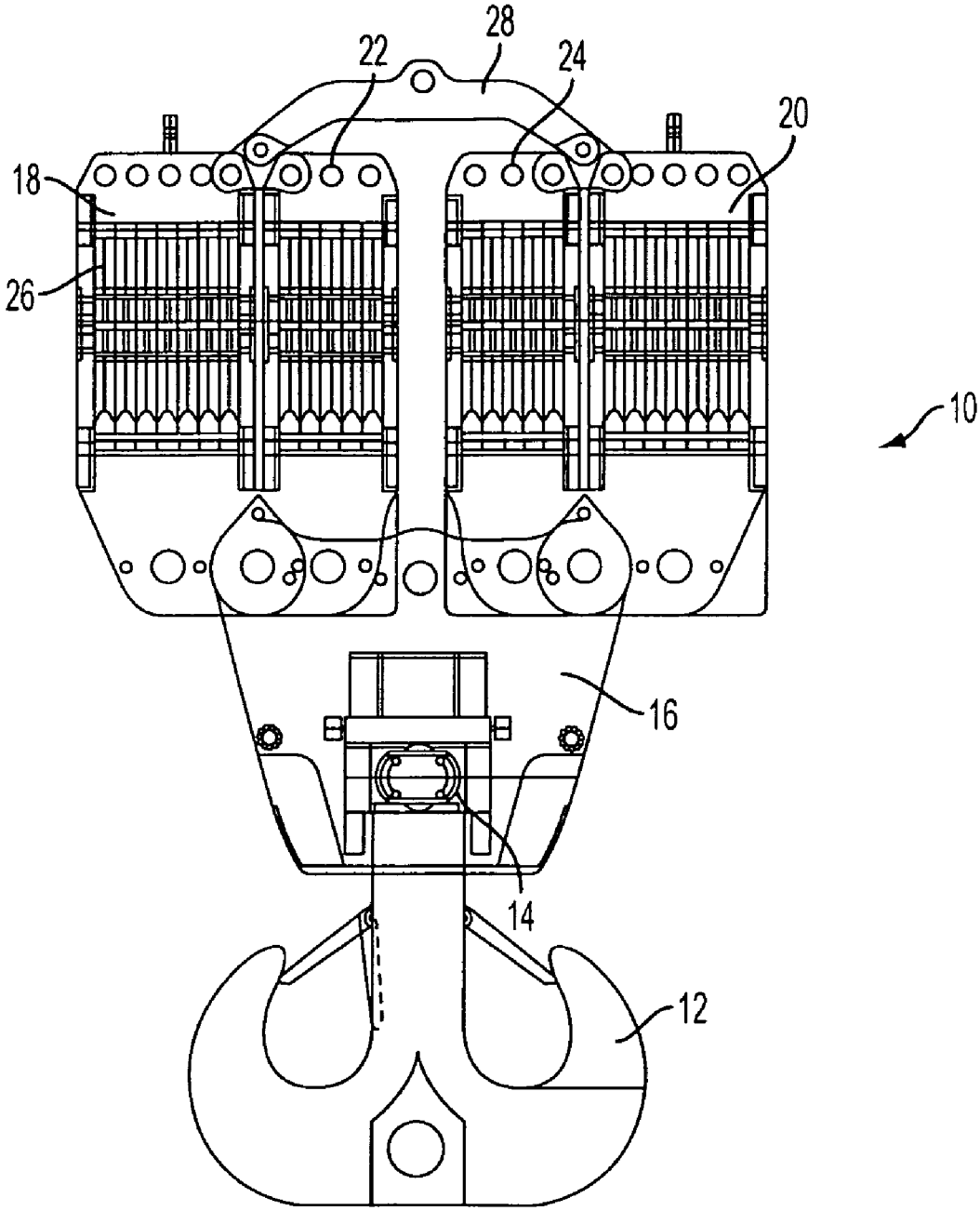
FIG. 1 shows a hook-type bottom block in accordance with an embodiment variant of the present disclosure in the fully set-up state.

A hook-type bottom block 10 in the modular construction in accordance with the present disclosure is shown in FIG. 1. Here, a hook 12 is supported pivotably around a pivot bearing 14 in a hook yoke 16. The hook yoke 16 forms the lower part of the hook-type bottom block 10 together with the pivotably supported hook 12. The upper part of the hook-type bottom block 10 is formed by a plurality of roller sets 18, 20, 22 and 24 which can be connected to one another in the manner of a module. These roller sets can be connected to one another in a modular manner, with the connection here typically taking place via a bolt connection. In the embodiment shown here, the roller sets 18 and 20 or 22 and 24 respectively are provided with the same number of rollers. The roller sets 18 and 20 thus each have seven rollers 26, whereas the roller sets 22 and 24 each have five rollers 26. As shown in FIG. 1, the roller sets 18 and 22, on the one hand, and 20 and 24, on the other hand, are bolted to one another, with them each being bolted to the hook yoke 16 such that an oscillating movement is permitted. The two roller sets 18 and 22 or 20 and 24 respectively, which are combined together, are connected to one another via a hoop 28 at the side disposed opposite the hook yoke 16.

The different number of rollers 26 in the roller sets 18, 20, 22 and 24 generally make it possible to realize different hook-type bottom blocks 10. In the embodiment in accordance with FIG. 1, the hook-type bottom block 10 is set up such that two hoist ropes can be sheared in by two winches. This is necessary since a single hoist rope length would not be sufficient to lower the hook-type bottom block 10 onto the ground. This means that both winches (not shown here) are run in parallel operation. The different running behavior of the two winches is compensated via the hook yoke 16.

Figure 2:
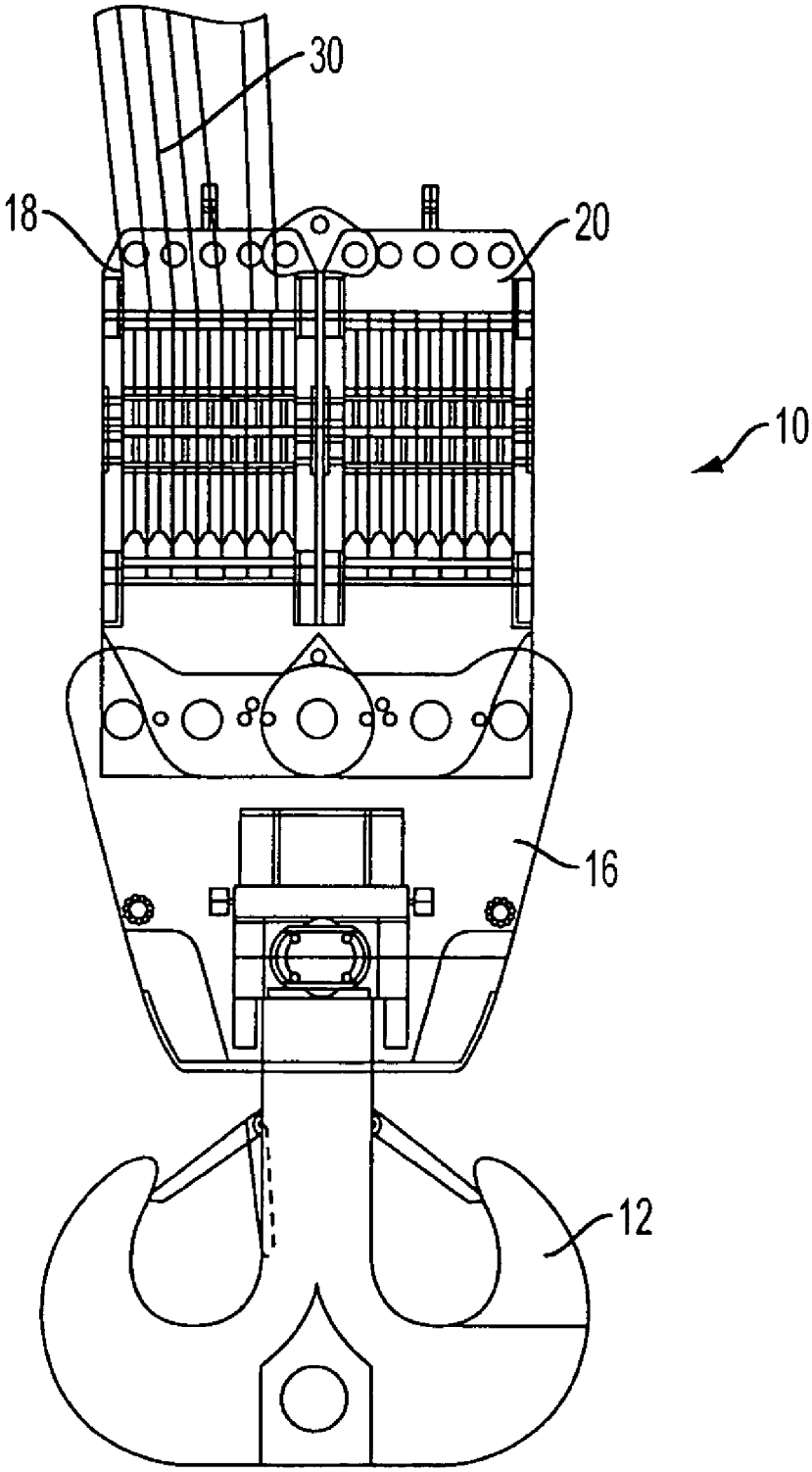
FIG. 2 shows a combination of some of the roller sets in accordance with the hook-type bottom block in accordance with FIG. 1.

In FIG. 2, a different modular-type combination of the hook-type bottom block 10 is shown. Here, the roller sets 18 and 20 are coupled to one another such that they act as one single roller set. For this purpose, the roller sets 18 and 20 are rigidly coupled to one another. The lower part of the hook-type bottom block 10 consisting of the hook yoke 16 and the pivotable hook 12 is seated in a typical manner beneath this upper part of the hook-type bottom block 10 formed from the roller sets 18 and 20. This embodiment serves the shearing in with only one winch. The hoist ropes 30 are here shown on one side in the form of a so-called oblique pull at an angle of >4°.

Figure 3:
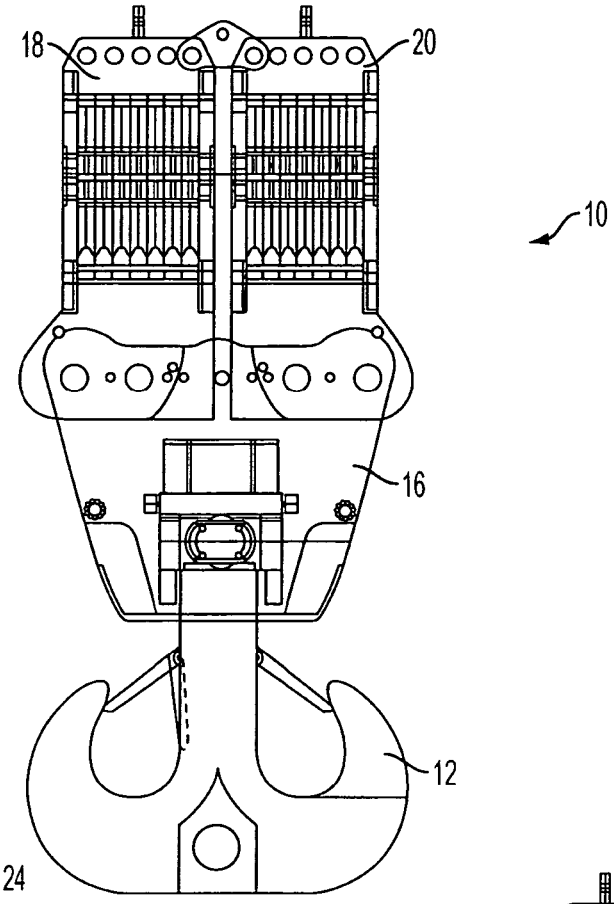
FIG. 3 shows a combination of some other roller sets in another stage of development of the hook-type bottom block in accordance with FIG. 1.

A further embodiment of the present disclosure which shows a hook-type bottom block 10 made up of the roller set modules 18 and 20 results from FIG. 3. There, the roller set modules are connected to one another in an oscillating manner so that in turn a rope length compensation can take place when here two hoist ropes, which run off via two winches, are sheared in.

Figure 4:
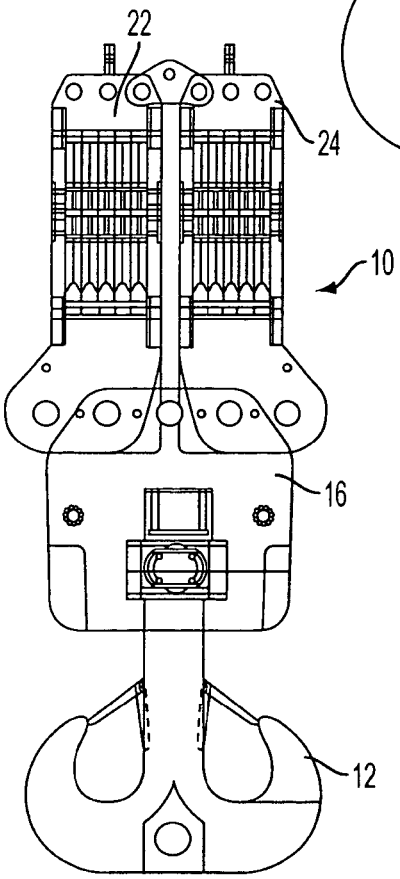
FIGS. 4 and 5 show further stages of development of a hook-type bottom block in accordance with the embodiment variant shown in FIG. 1.

In FIG. 4, an embodiment of the hook-type bottom block 10 is shown in which the two narrow roller sets 22 and 24 are used. They are bolted together in the manner shown here. A hook yoke 16 with hooks 12 can be bolted thereto. This hook-type bottom block 10 made up of the narrow roller sets 22 and 24 can be used, together with a hook-type bottom block such as was shown with reference to FIG. 2, with the hook-type bottom block 10 being used in accordance with FIG. 2 at a main boom tip of a mobile crane, whereas this hook-type bottom block shown in accordance with FIG. 4 is used as a second further hook-type bottom block at the luffing tip of a vehicle crane. In this installation case, a second hook 12 must admittedly be used, but the roller sets such as were originally provided in the stage of development of FIG. 1 and such as are optionally taken along can be connected to one another in a modular manner so that the two embodiments in accordance with FIG. 2 and FIG. 4 arise and can be used simultaneously in one mobile crane.

Figure 5:
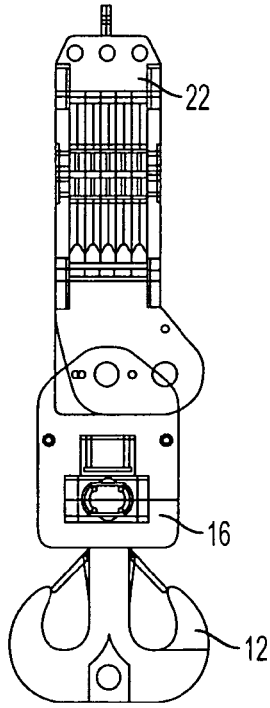

Finally, the embodiment in accordance with FIG. 5 shows the use of an individual narrow roller set 22 having a small hook 12 and a corresponding hook yoke 16.

The combination possibilities shown here for the hook-type bottom block set up in a modular manner are only shown by way of example. Any desired further combinations are possible.

The invention claimed is:

1. A hook-type bottom block for a crane, comprising:

a lower part where a hook is fastened to a hook yoke via a pivot bearing; and an upper part where a plurality of rollers are supported and via which at least one hoist rope can be sheared in, the plurality of rollers combined into a plurality of roller set modules, the roller set modules connectable to one another in a modular manner, and bolted to each other and to the hook yoke such that an oscillating movement of the roller set modules is permitted.

2. The hook-type bottom block in accordance with claim 1, wherein the roller set modules are coupled to the hook via the hook yoke in the lower part, and connected to each other via a hoop in the upper part.

3. The hook-type bottom block in accordance with claim 1, wherein two roller set modules having different numbers of rollers are connected to one another.

4. The hook-type bottom block in accordance with claim 3, wherein at least two of the roller set modules are rigidly coupled to one another.

5. The hook-type bottom block in accordance with claim 4, further configured for two hoist ropes sheared in from two winches, wherein a different running behavior of the two winches is compensated via the hook yoke.

6. The hook-type bottom block in accordance with claim 4, wherein the roller set modules rigidly coupled to one another are disposed on a same end of the hook yoke.

7. The hook-type bottom block in accordance with claim 1, wherein the plurality of roller set modules are disposed at the same height.

8. The hook-type bottom block in accordance with claim 1, wherein the roller set modules are bolted directly to the hook yoke.

9. A modular pulley system for a mobile crane, the modular pulley system comprising:

at least one hoist rope;

a hook-type bottom block, comprising:

a lower part where a hook is fastened to a hook yoke via a pivot bearing; and an upper part where a plurality of rollers are supported and via which the at least one hoist rope can be sheared in, the plurality of rollers combined into a plurality of roller set modules, the roller set modules connectable to one another in a modular manner, and bolted to each other and to the hook yoke such that an oscillating movement of the roller set modules is permitted; and a hoop configured to connect the roller set modules at a side of the roller set modules opposite the hook yoke.

10. The modular pulley system in accordance with claim 9, wherein the roller set modules are coupled to the hook via the hook yoke in the lower part, and connected to each other via a hoop in the upper part.

11. The modular pulley system in accordance with claim 10, wherein two roller set modules having different numbers of rollers are connected to one another.

12. The modular pulley system in accordance with claim 11, wherein at least two of the roller set modules are rigidly coupled to one another.

13. The modular pulley system in accordance with claim 12, further comprising a second hoist rope, the first and second hoist ropes sheared in via two winches, wherein a different running behavior of the two winches is compensated via the hook yoke.

14. The modular pulley system in accordance with claim 12, wherein the roller set modules rigidly coupled to one another are disposed on a same end of the hook yoke.

15. The modular pulley system in accordance with claim 9, wherein the plurality of roller set modules are disposed at the same height.

16. A method of configuring a hook-type bottom block for a crane, the hook-type bottom block having a lower part to which the hook is fastened via a pivot bearing and an upper part in which rollers are supported via which at least one hoist rope can be sheared in, where the rollers are combined into a plurality of roller set modules, and the roller set modules are each modularly connectable to one another, the method comprising:

combining a plurality of roller set modules, the roller set modules connectable to one another in a modular manner; and bolting the roller set modules to each other and to a hook yoke to permit an oscillating motion of the roller set modules, the hook yoke supporting a hook via a pivot bearing.

17. The method of claim 16 wherein the plurality of roller set modules includes a pair of roller set modules having different numbers of rollers, the pair of roller set modules boltable to one another, the method further comprising shearing two hoist ropes in from two winches, a different running behavior of the winches compensated via the hook yoke.

18. The method of claim 16, further comprising rigidly coupling at least two roller set modules disposed on a same end of the hook yoke.

* * * * *